United States Patent [19]

Pinto et al.

[11] Patent Number: 5,044,046

[45] Date of Patent: Sep. 3, 1991

[54] BLENDING DEVICE FOR SPINNING MATERIAL FIBERS

[75] Inventors: Akiva Pinto, Duesseldorf-Wittlaer; Guenter Lucassen, Haltern, both of Fed. Rep. of Germany

[73] Assignee: Hergeth Hollingsworth GmbH, Duelmen, Fed. Rep. of Germany

[21] Appl. No.: 510,343

[22] Filed: Apr. 16, 1990

[30] Foreign Application Priority Data

Apr. 17, 1989 [DE] Fed. Rep. of Germany ..... 3912559

[51] Int. Cl.[5] ..... D01G 23/02; B65G 65/30

[52] U.S. Cl. ..... 19/145.5; 19/205

[58] Field of Search ..... 19/145.5, 200, 204, 19/205, 85, 95

[56] References Cited

U.S. PATENT DOCUMENTS

| | | | |
|---|---|---|---|
| 631,800 | 8/1899 | Lemoine | 19/85 |
| 1,942,068 | 1/1934 | Mitchell | 19/204 |
| 2,885,741 | 5/1959 | Leineweber, Jr. | 19/145.5 |
| 3,386,135 | 6/1968 | Clifford et al. | 19/200 |
| 3,559,804 | 2/1971 | Lytton | 19/205 X |
| 3,889,319 | 6/1975 | Roberson | 19/145.5 |
| 4,592,115 | 6/1986 | Holmstrom | 19/200 X |
| 4,866,815 | 9/1989 | Lucassen et al. | 19/200 X |

FOREIGN PATENT DOCUMENTS

| | | | |
|---|---|---|---|
| 1510388 | 1/1972 | Fed. Rep. of Germany | 19/205 |
| 3633700 | 4/1988 | Fed. Rep. of Germany | 19/145.5 |
| 0806790 | 2/1981 | U.S.S.R. | 19/145.5 |
| 1555487 | 11/1979 | United Kingdom | 19/145.5 |
| 2142050 | 1/1985 | United Kingdom | 19/145.5 |
| 2171677 | 9/1986 | United Kingdom | 19/145.5 |

*Primary Examiner*—Werner H. Schroeder
*Assistant Examiner*—John J. Calvert
*Attorney, Agent, or Firm*—Cort Flint

[57] ABSTRACT

In a blending device (1) for textile fibers, e.g. fiber flocks of cotton, comprising a fiber collecting device into which disintegrated fiber flocks drop after blending. A horizontal suction channel (10) is arranged at a lower end of the collecting device in which an airflow is created which transports the fiber flocks. The suction channel (10) has a waste collecting chamber (21) arranged in the entrance opposite the fiber collecting device. The waste collecting chamber is separated from the suction channel (10) by a grate (16) arranged in a plane of the surface of the suction channel, and the airflow in the entrance of the fiber collecting device sorts the fiber flocks in a transverse flow which transports the textile fibers down the suction channel while allowing the heavier trash and impurities to fall through the grate (FIG. 2).

9 Claims, 2 Drawing Sheets

BLENDING DEVICE FOR SPINNING MATERIAL FIBERS

BACKGROUND OF THE INVENTION

The invention relates to a blending device for textile fibers.

Blending devices for textile fibers are needed in spinning mills to improve the quality of the yarn (strength, uniformity and dyeing behavior). In the non-wovens industry blending devices improve the quality of the non-woven fabric (strength, uniformity and the area distribution of the fibers), whether the textile products concerned are made of natural or synthetic fibers. Growth-related differences in natural fibers and production-related differences in synthetic fibers that not only occur from bale to bale, but also within one bale, have to be compensated prior to the forming of slubbings for the making of yarn. A homogenous blending of the fibers is necessary in order to reach maximum spin-out limits and to keep the fiber breakage time at an extremely low level. This is because of differences in fineness, fiber lengths, degree of maturity and color.

In a blending device known as a "laydown cross blender" manufactured by the Hergeth Hollingsworth Co. GmbH, blending is effected by means of a reducing member in connection with a feeding machine which reciprocates over a rectangular area in the working direction over the working width. The fiber material is first stored in a sandwich-like manner in the filling chamber of such a blending device by the feeding machine and subsequently reduced by the reducing device. The reduced fiber flocks are combed out of the reducing device by a stripping roller and supplied to a funnel-shaped chute where the fiber flocks, due to gravity, fall into a horizontally extending suction channel in which they are further transported by means of an air flow.

An object of the invention to provide a blending device in which, after the blending of the fiber flocks, a cleaning of the fiber material is possible prior to the transport thereof.

SUMMARY OF THE INVENTION

The object is solved according to the present invention by providing a blending device in which fiber flocks, blended and reduced again in the blending device, drop vertically downward in the fiber collecting device into the suction channel. A horizontal flow in the suction channel transports the fiber flock to subsequent machines. A waste collecting chamber, separated by a grate, is arranged on the side of the suction channel vertically opposite the entrance area. This makes it is advantageously possible to obtain a transverse air flow which sorts the fiber material as the fiber flocks drop vertically due to gravity with the impurities, e.g. heavy particles like husk particles, leaf and stem particles and the like. The fiber flocks are caught by the transverse horizontal air flow in the suction channel, and are transported away while the impurities fall through the grate into the waste collection chamber. The fiber flocks, due to their aerodynamic behavior (a low aerodynamical equivalent diameter) and their low specific weight, can be directly deflected by the air flow, and the heavy trash particles have a higher inertia so that they cannot be directly deflected into the horizontal suction channel. In this way, the heavy particles, and thus the impurities still contained in the fiber flocks, can be separated into the waste collecting chamber, while the fiber flocks are deflected into the suction channel and are carried away. The grate preferably extends beyond the entrance area in the downstream direction of the suction channel. The extension of the grate in the downstream direction allows reliable separation even lighter impurities that resemble the fiber flocks in their specific weight, but not in their aerodynamic behavior. Preferably, the waste collecting chamber is closed to prevent the occurrence of an air flow towards the air collecting chamber which could take fibers along. It is also possible to provide a waste collecting sack that may not provide a 100 percent air-tight sealing of the waste collecting chamber, but only allows a negligible air flow. Preferably, the collecting device consists of a channel, vertically tapered in a funnel-like fashion, the upstream funnel wall of which projects into the suction channel. The other, downstream funnel wall ends at the surface area of the suction channel. The funnel wall projecting into the suction channel forms a nozzle-shaped contraction of the suction channel at the entrance area of the fiber flocks. The flow rate at this point is increased over a short period of time to effectively deflect the fiber flocks at this point. The suction width is widened immediately after this point, and the flow rate may decrease after this point of deflection, to facilitate the separation of the heavy trash particles at the grate. The upstream funnel wall enters the suction channel at an angle of preferably 45° to form a chute pointing in the flow direction of the transport air flow. The rear funnel wall may advantageously be used at the same time as a nozzle-shaped constriction of the suction width. The upstream funnel wall may project into the suction channel up to approximately half the width of suction channel. This effectively doubles the rate of air flow for a short time at the earliest point of entrance of the fiber flocks.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
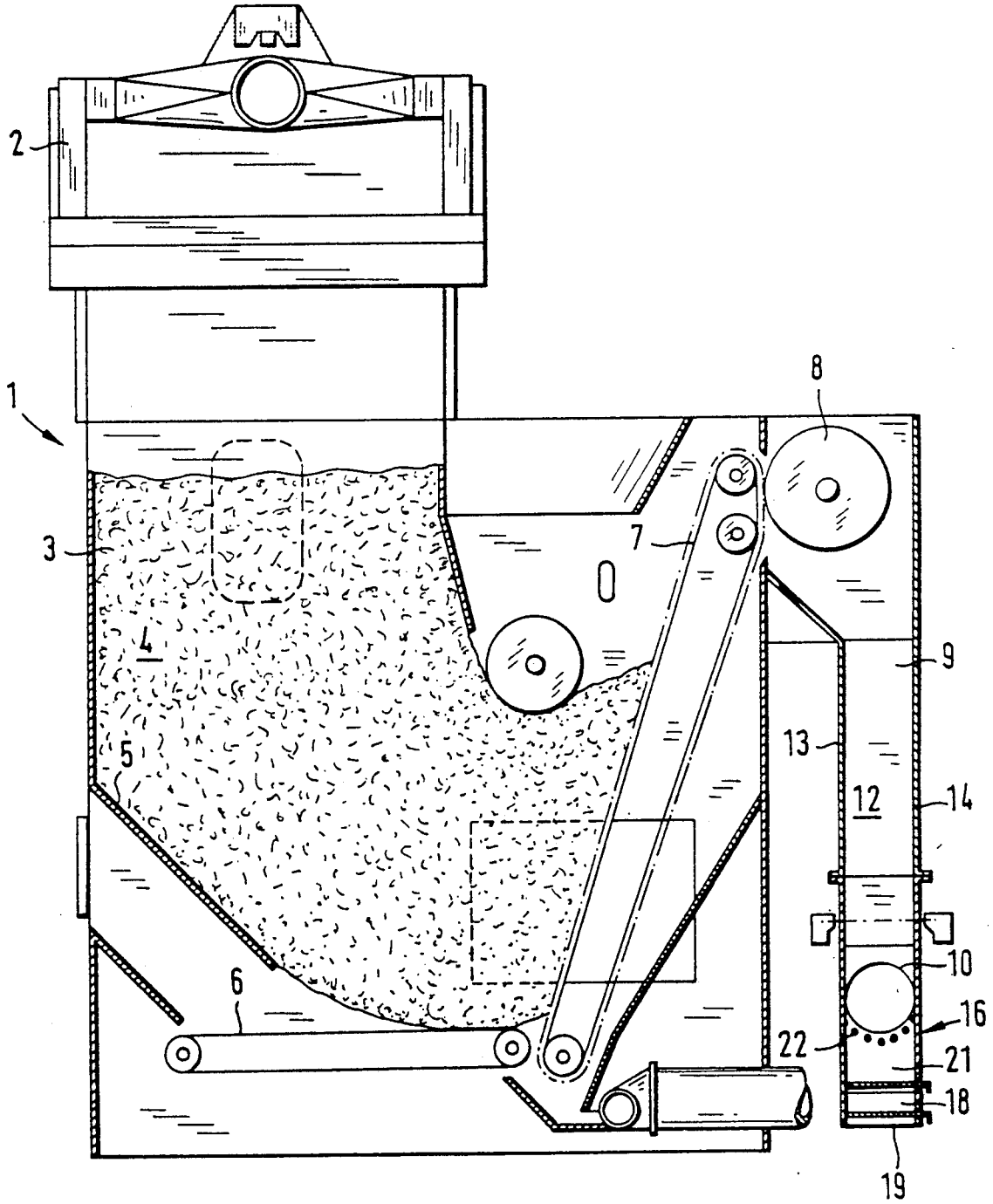
FIG. 1 is a schematic lateral section view of the blending device.
Figure 2:
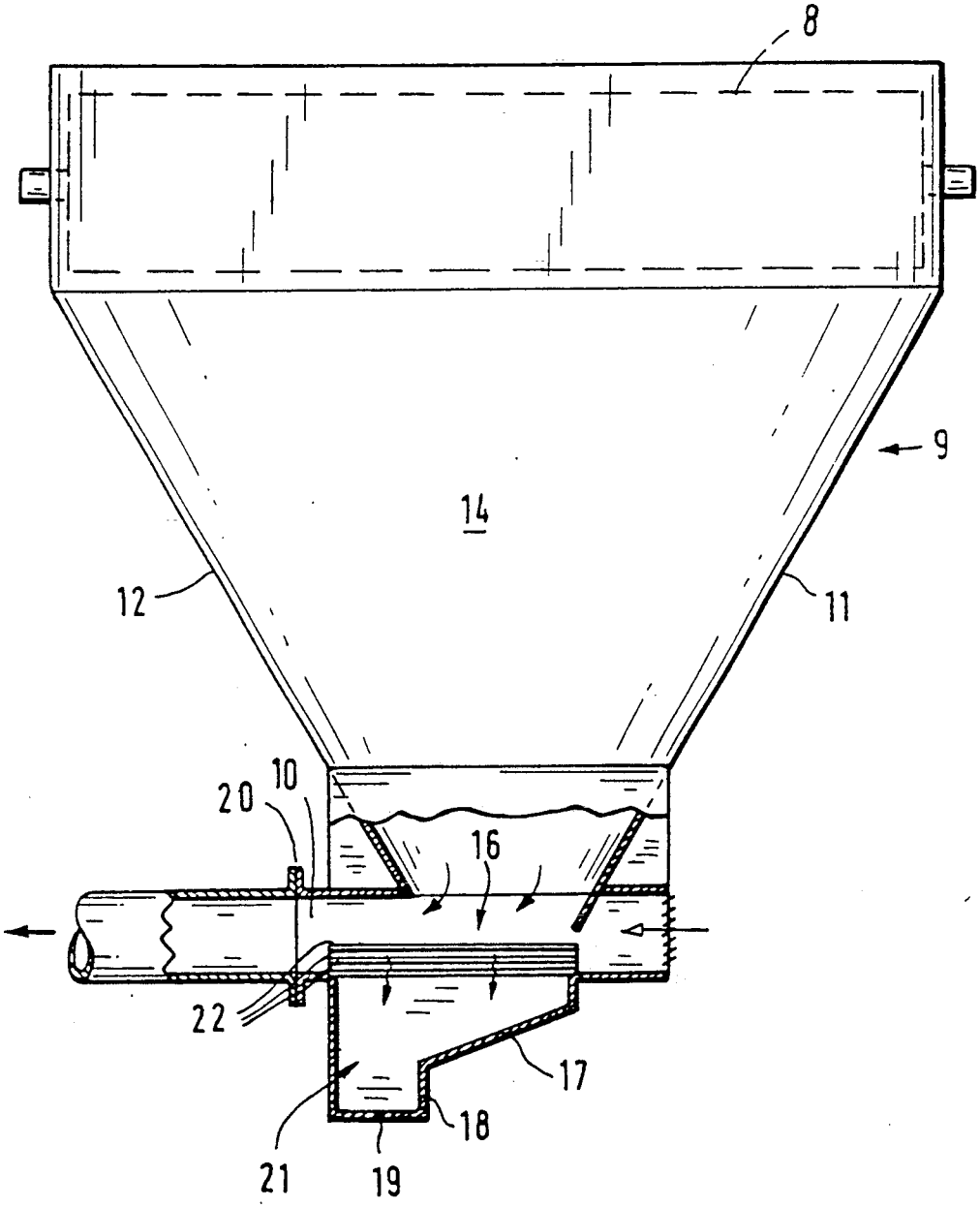
FIG. 2 is a front view of the funnel-shaped fiber collecting device with the blending device according to the invention.

FIG. 1 illustrates a blending device 1 and a feeding device 2 reciprocating transverse to the working direction over the working width of the blending device 1. Fiber material 3 is stored in the filling chamber 4 of the blending device 1 in a sandwich-like manner. The injection of air transverse to the working direction by the feeding device causes a distribution of the fiber flocks supplied by the feeding machine over the entire working width of the feeding device, thereby providing an additional blending. The fiber flocks separated from the transport air drop onto a chute plate 5 arranged at a special angle relative to a bottom lattice 6. These two devices form the bottom delimiting surface on which the fed fiber material 3 may be stored and piled up in a sandwich-like manner to form a fiber column. The column of fiber material, built up in a sandwich fashion and transverse to the working direction, is presented to a reducing device. The reducing device is illustrated as an upright spiked lattice 7, operating in the working direction, in the best possible manner, and with a continuous contact pressure. The upright spiked lattice 7 transversely reduces the sandwich fiber column, longitudinally piled up over the width, and over the entire working width. In the continuous blending operation, there results a continuous longitudinal piling with a continuous transversal take-off. The upright spiked lattice 7 is combed out by a stripping roller 8. The opened and combed fiber flocks drop into a subsequent collecting device 9, at the lower of the collecting device, the fibers are discharged via a horizontal suction channel 10.

The collecting device 9 consists of a vertically downward tapered funnel-shaped chute with two parallel chute walls 13, 14 and two funnel walls 11, 12 tapered at an angle of approximately 45°. The downstream funnel wall 12 extends transverse to suction channel 10 and ends at the surface area 15 of the suction channel 10. Upstream funnel wall 11 extends transversely to suction channel 10 and projects into suction channel 10 up to one half thereof to reduce the suction width at this point to one half. Suction channel 10 has a circular cross section so that the funnel wall 11, extending into the suction channel, up to one half thereof, forms a semi-circular cross section. A grate 16 extends downstream from the constriction of the cross section beyond the entrance area of the funnel-shaped collecting device 9. The grate length may be 70 to 100 cm. The grate 16 forms the bottom surface area of the suction channel 10. Grate 16 includes a plurality of bars 22 arranged in a circumference which is approximately $\frac{1}{4}$ to $\frac{1}{3}$ of the circumference of the suction channel. Bars 22 extend horizontally and linearly in the direction of the suction channel. Preferably, the bars are round, as can best be seen in FIG. 1, and are spaced apart a distance in the range of between 1 and 3 centimeters. A waste collecting chamber 21 is arranged below grate 16. A chute 17 leads from grate 16 to a connection piece 18. Connection piece 18 may be closed with a bottom lid 19. Instead of the bottom lid 19, a waste sack may be provided. Suction channel 10 terminates in a short joining pipe behind the upstream funnel wall 11 and may have an air-permeable meshed wall through which the transport air is drawn in. Downstream, the suction channel is provided with a connection piece 20, circular in cross section, to which an extraction fan or further conduits may be connected.

The fiber flocks falling substantially vertically into suction channel 10, together with the trash and impurities, are subjected to a transverse flow and sorting. The flow rate is temporarily doubled at the earliest point of entrance of the fiber flocks which causes a strong deflecting effect for the fibers in the direction of the suction channel. The widening of the cross section occurring directly after the funnel wall 11 reduces the flow rate in the suction channel 10 by approximately one half to facilitate separation of material other than fibers. The length of the grate 16 not only permits the separation of heavy particles, but also that of other impurities like trash particles.

While a preferred embodiment of the invention has been described using specific terms, such description is for illustrative purposes only, and it is to be understood that changes and variations may be made without departing from the spirit or scope of the following claims.

What is claimed is:

1. A blending device for textile fiber material, comprising a fiber collecting device into which the disintegrated fiber flocks drop after blending, and a horizontal suction channel having an entrance arranged at a lower end of said collecting device, an airflow created in said suction chamber for transporting said fiber flocks, wherein said device comprises a waste collecting chamber communicating with said fiber collecting device and said suction chamber; said waste collection chamber being disposed generally vertically below said suction chamber and arranged opposite said entrance of said suction channel on a side opposite said fiber collecting device; a grate separating said waste collecting chamber from said suction chamber having a plurality of grid bars extending generally parallel to said airflow in the direction of said suction channel; and means for creating an impurities classifying airflow near said entrance of said suction channel which varies in its flow rate in the direction of said grate and suction channel to transport and sort said fiber flocks and impurities in said textile material so that the textile fibers are transported down said suction channel while said impurities are permitted to fall through said grate into said waste collection chamber.

2. The blending device of claim 1 wherein said fiber collecting device includes a chute tapered vertically in a funnel having an upstream funnel wall which extends into said suction channel and forms a nozzle-shaped constriction which provides said airflow creating means, and a downstream funnel wall of said funnel terminates at said surface of said suction channel.

3. The blending device as set forth in claim 1 wherein said grate extends downstream beyond said entrance of said suction channel.

4. The blending device as set forth in claim 1 wherein said waste collecting chamber is configured in a closed manner.

5. The blending device as set forth in claim 4 wherein said upstream funnel wall extends into said suction channel at an angle of approximately 45°.

6. The blending device as set forth in claim 1 wherein of said grate has a circumference approximately one fourth to one third of a circumference of said suction channel.

7. The blending device as set forth in claim 1 wherein said grate bars are round bars.

8. The blending device as set forth in claim 1 wherein said grate bars are spaced apart at a distance between 1 and 3 cm.

9. A blending device for textile fiber material, comprising a fiber collecting device into which the disintegrated fiber flocks drop after blending, and a horizontal suction channel having an entrance arranged at a lower end of said collecting device, an airflow created in said suction chamber for transporting said fiber flocks, wherein said device comprises a waste collecting chamber communicating with said fiber collecting device and said suction chamber; said waste collection chamber being disposed generally vertically below said suction chamber and arranged opposite said entrance of said suction channel on a side opposite said fiber collecting device; a grate separating said waste collecting chamber from said suction channel; means for creating an airflow near said entrance of said suction channel which varies in its flow rate to transport and sort said fiber flocks and impurities in said textile material so that the textile fibers are transported down said suction channel while said impurities are permitted to fall through said grate into said waste collection chamber; and said collecting device includes an upstream funnel wall which extends into said suction channel to up to one half of the cross section of said suction channel.

* * * * *